US010801434B2

(12) United States Patent
Dölker

(10) Patent No.: US 10,801,434 B2
(45) Date of Patent: Oct. 13, 2020

(54) METHOD FOR DETECTING CONTINUOUS INJECTION DURING THE OPERATION OF AN INTERNAL COMBUSTION ENGINE, INJECTION SYSTEM FOR AN INTERNAL COMBUSTION ENGINE AND INTERNAL COMBUSTION ENGINE

(71) Applicant: MTU FRIEDRICHSHAFEN GMBH, Friedrichshafen (DE)

(72) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 221 days.

(21) Appl. No.: 15/543,132

(22) PCT Filed: Mar. 16, 2016

(86) PCT No.: PCT/EP2016/000469

§ 371 (c)(1),
(2) Date: Jul. 12, 2017

(87) PCT Pub. No.: WO2016/173689

PCT Pub. Date: Nov. 3, 2016

(65) Prior Publication Data

US 2018/0010542 A1 Jan. 11, 2018

(30) Foreign Application Priority Data

Apr. 29, 2015 (DE) ..... 10 2015 207 961

(51) Int. Cl.
*F02D 41/22* (2006.01)
*F02D 41/38* (2006.01)

(52) U.S. Cl.
CPC ..... *F02D 41/221* (2013.01); *F02D 41/3863* (2013.01); *F02D 2041/225* (2013.01); *F02D 2200/0602* (2013.01); *F02D 2250/14* (2013.01)

(58) Field of Classification Search
CPC ..... F02D 41/221; F02D 41/3863; F02D 2041/225; F02D 2200/0602; F02D 2250/14

(Continued)

(56) References Cited

U.S. PATENT DOCUMENTS 5,022,364 A * 6/1991 Phillips ..... F02M 65/008 123/198 A
5,117,683 A * 6/1992 Phillips ..... F02M 65/008 73/114.38

(Continued)

FOREIGN PATENT DOCUMENTS

DE 19620038 A1 11/1997
DE 102005008180 A1 8/2006

(Continued)

*Primary Examiner* — David Hamaoui
*Assistant Examiner* — John D Bailey
(74) *Attorney, Agent, or Firm* — Lucas & Mercanti, LLP; Klaus P. Stoffel

(57) ABSTRACT

A method for detecting continuous injection during the operation of an internal combustion engine with an injection system having a high-pressure accumulator for a fuel, wherein—a high pressure in the injection system is monitored as a function of time, wherein—in order to detect continuous injection it is checked whether the high pressure has dropped by a predetermined continuous injection differential pressure value within a predetermined continuous injection time interval, wherein—it is checked whether a reduction valve which connects the high-pressure accumulator to a fuel reservoir has been triggered, and wherein—continuous injection is detected if—a reduction valve has not been triggered in a predetermined checking time interval before the dropping of the high pressure, and if—the high pressure has dropped by the predetermined continuous injec- (Continued)

tion differential value amount within the predetermined continuous injection time interval.

3 Claims, 5 Drawing Sheets

(58) Field of Classification Search
USPC ..... 123/478
See application file for complete search history.

(56) References Cited

U.S. PATENT DOCUMENTS 5,633,458 A * 5/1997 Pauli ..... F02D 41/22 701/105
5,708,202 A * 1/1998 Augustin ..... F02D 41/221 73/114.43
5,715,786 A * 2/1998 Seiberth ..... F02D 41/22 123/198 D
7,556,023 B2 * 7/2009 Ilhoshi ..... F02D 41/3836 123/480
7,650,779 B2 * 1/2010 Puckett ..... F02M 65/002 73/114.41
7,762,234 B2 * 7/2010 Ulrey ..... F02D 41/3845 123/456
7,779,678 B2 * 8/2010 Wolber ..... F02D 41/221 73/114.45
8,051,839 B2 * 11/2011 Spadafora ..... F02D 41/2096 123/498
8,291,889 B2 * 10/2012 Shafer ..... F02M 63/025 123/458
8,511,153 B2 * 8/2013 Serra ..... F02D 41/221 73/114.51
8,511,275 B2 * 8/2013 Nistler ..... F02D 41/3863 123/198 D
8,812,215 B2 * 8/2014 Sugiyama ..... F02D 41/3845 701/104
9,347,409 B2 * 5/2016 Dolker ..... F02M 41/16
9,441,572 B2 * 9/2016 Dolker ..... F02D 41/3863
10,041,432 B2 * 8/2018 Puckett ..... F02D 41/3082
2003/0213294 A1 * 11/2003 Date ..... G01L 19/02 73/114.45
2004/0055576 A1 * 3/2004 McCarthy, Jr. ..... F02P 5/1504 123/458
2005/0092301 A1 * 5/2005 Fukuda ..... F02M 59/366 123/446
2005/0103312 A1 * 5/2005 Uchiyama ..... F02D 41/1401 123/457
2005/0235964 A1 * 10/2005 Shibata ..... F02D 41/3809 123/458
2007/0079792 A1 * 4/2007 Dingier ..... F02D 41/3836 123/198 D
2007/0283934 A1 * 12/2007 Okamura ..... F02D 41/3845 123/495
2008/0041331 A1 * 2/2008 Puckett ..... F02D 41/38 123/198 D
2008/0060617 A1 * 3/2008 Adachi ..... F02D 41/009 123/447
2008/0228374 A1 * 9/2008 Ishizuka ..... F02D 41/3836 701/103
2009/0020630 A1 * 1/2009 Yan ..... G01M 15/06 239/533.1
2009/0056677 A1 * 3/2009 Nakata ..... F02D 41/2435 123/480
2009/0056678 A1 * 3/2009 Nakata ..... F02D 41/221 123/480
2009/0164094 A1 * 6/2009 Geveci ..... F02D 41/0087 701/103
2010/0043753 A1 * 2/2010 Gallagher ..... F02D 41/40 123/447
2010/0132668 A1 * 6/2010 Borchsenius ..... F02D 41/3872 123/447
2013/0013174 A1 * 1/2013 Nistler ..... F02M 59/366 701/112
2013/0253804 A1 * 9/2013 Rosel ..... F02D 41/06 701/104
2013/0255636 A1 * 10/2013 Pursifull ..... F02D 19/0613 123/446
2016/0186709 A1 * 6/2016 Walder ..... F02M 65/001 73/114.51
2016/0245221 A1 * 8/2016 McEwan ..... F02D 41/40
2016/0298569 A1 * 10/2016 Bays ..... F02D 41/3836
2017/0022927 A1 * 1/2017 Sanborn ..... F02M 59/20
2018/0023501 A1 * 1/2018 Ottikkutti ..... F02D 41/2438 123/456

FOREIGN PATENT DOCUMENTS

DE 102007052451 A1 5/2009
DE 102009031527 B3 11/2010
DE 102011100187 B3 11/2012
DE 102013216255 B3 11/2014
EP 0857867 A1 8/1998

* cited by examiner

METHOD FOR DETECTING CONTINUOUS INJECTION DURING THE OPERATION OF AN INTERNAL COMBUSTION ENGINE, INJECTION SYSTEM FOR AN INTERNAL COMBUSTION ENGINE AND INTERNAL COMBUSTION ENGINE

The present application is a 371 of International application PCT/EP2016/000469, filed Mar. 16, 2016, which claims priority of DE 10 2015 207 961.9, filed Apr. 29, 2015, the priority of these applications is hereby claimed and these applications are incorporated herein by reference.

BACKGROUND OF THE INVENTION

The invention relates to a method for detecting continuous injection during the operation of an internal combustion engine, an injection system for an internal combustion engine and an internal combustion engine having an injection system.

German patent DE 10 2011 100 187 B3 discloses a method for performing open-loop and closed-loop control of an internal combustion engine with a common rail system as well as a passive pressure-limiting valve for diverting fuel from a rail into a fuel tank in which an open pressure-limiting valve is detected if the rail pressure both exceeds a first limiting value and undershoots a second, relatively low limiting value, within a predetermined time period. Continuous injection is not detectable with this method. Continuous injection refers to an event in which fuel leaks through a fuel injector into a combustion chamber of an internal combustion engine even outside predetermined injection times, in particular continuously. Such continuous injections can be caused by sticking nozzles, needles or injectors which are defective in some other way. Such events result in an excessively large quantity of fuel being fed to the affected combustion chamber of the internal combustion chamber, which, during the operation of the internal combustion engine, can cause malfunctions and even damage to the internal combustion engine. In order to protect internal combustion engines against such events, quantity-limiting valves are typically installed which are provided, in particular, integrated into injectors. However, such quantity-limiting valves are typically fabricated in small series, in which case they are complex and expensive to manufacture. In contrast, injectors which are fabricated in large-scale series production typically do not have quantity-limiting valves. In order to be able to lower costs in the context of the manufacture and the operation of an internal combustion engine, it is desirable to be able to detect continuous injection even in situations other than by means of the impacting of a quantity-limiting valve.

SUMMARY OF THE INVENTION

The invention is based on the object of providing a method and an injection system for an internal combustion engine and an internal combustion engine in which the specified disadvantages do not occur. In particular, by means of the method, the injection system and the internal combustion engine it is to be possible to be able to detect continuous injections independently of the presence of a quantity-limiting valve.

The object is achieved, in particular, in that a method for detecting continuous injection during operation of an internal combustion engine is provided, wherein in the scope of the method an internal combustion engine is operated which has an injection system which has a high-pressure accumulator for a fuel. Within the scope of the method, a high pressure in the injection system is monitored as a function of time, wherein in order to detect continuous injection it is checked whether the high pressure has dropped by a predetermined continuous injection differential pressure absolute value within a predetermined continuous injection time interval. Checking carries on—in particular continuously—as to whether a deactivation valve which connects the high-pressure accumulator to a fuel reservoir has been triggered. Continuous injection is detected if no deactivation valve has been triggered in a predetermined checking time interval before the dropping of the high pressure and if the high pressure has dropped by the predetermined continuous injection differential pressure absolute value within the predetermined continuous injection time interval. By means of the method proposed here it is readily possible to detect a continuous injection event on the basis of the detected high pressure, in particular without a quantity-limiting valve having to be used. In this context, the drop in the high pressure by the predetermined continuous injection differential pressure absolute value within the predetermined continuous injection time interval forms a safe criterion for being able to reliably infer continuous injection, in particular when other events which cause such a pressure drop are excluded. As a result of the fact that continuous injection is detected when at the same time as the drop in the high pressure it is also determined that in a predetermined checking time interval before the drop in the high pressure by the predetermined continuous injection differential pressure absolute value no deactivation valve has been triggered, it can reliably be ruled out that the determined drop in the high pressure can be attributed to another event, specifically the triggering of a deactivation valve. As a result of this exclusion, incorrect interpretations of the pressure variation in the high pressure over time are avoided with a high degree of reliability, and it is possible to detect continuous injection very reliably as a cause for the drop in the high pressure.

There is particularly preferably provision here that within the scope of the method continuous injection is detected only if both conditions are satisfied at the same time, specifically that, on the one hand, the high pressure within the predetermined continuous injection time interval has dropped by the predetermined continuous injection differential pressure absolute value, wherein, on the other hand, no deactivation valve has been triggered in the predetermined checking time interval before the dropping of the high pressure. Therefore, it is possible to conclude, with a very high level of certainty, that continuous injection is the cause of the drop in the high pressure, wherein the continuous injection can be detected and diagnosed as a result of the dropping of the high pressure. It is then readily possible, after the detection of the continuous injection, to initiate measures which protect the internal combustion engine against damage.

Within the scope of the method, an internal combustion engine is preferably operated which has what is referred to as a common rail injection system. Here, in particular a high-pressure accumulator is provided for fuel and is fluidically connected to at least one, preferably to a multiplicity of injectors, for injecting fuel. The high-pressure accumulator acts as a buffer volume in order to buffer and damp pressure fluctuations brought about by individual injection events. For this purpose, there is, in particular, provision that the volume of fuel in the high-pressure accumulator is large compared to a volume of fuel injected within an individual injection event. In particular, if a plurality of injectors are provided, the high-pressure accumulator advantageously brings about a decoupling of the injection event which is assigned to various injectors, with the result that preferably an identical high pressure can be assumed for each individual injection event. It is additionally possible for the at least one injector to have an individual accumulator. In particular, there is preferably provision that a plurality of injectors have individual accumulators which are respectively separately assigned to the injectors. Said individual accumulators serve as additional buffer volumes and can very efficiently bring about an additional separation of the individual injection events from one another.

The monitoring of the high pressure in the injection system as a function of time means, in particular, that said high pressure is measured as a function of time. For this purpose, the high pressure which is present in the high-pressure accumulator is preferably measured, in particular, by means of a pressure sensor which is arranged on the high-pressure accumulator. In this context, the high-pressure accumulator proves to be a particularly suitable location for measuring the high pressure, in particular since here owing to the damping effect of the high-pressure accumulator on the individual injection events, short-term pressure fluctuations can be detected only to a small degree.

Within the scope of the method, there is preferably provision that it is not the measured raw values which are used as the high pressure but instead the measured high-pressure values are filtered, wherein the filtered high-pressure values are used as the basis of the method. For this purpose, a $PT_1$ filter is particularly preferably used. This filtering has the advantage that short-term high-pressure fluctuations can be filtered out, which fluctuations could otherwise disrupt reliable detection of a drop in the high pressure which actually indicates continuous injection. It is possible that the measured high-pressure values are also filtered during the operation of the internal combustion engine before the pressure regulation of the high pressure. In this context, a first filter, preferably embodied as a $PT_1$ filter, is preferably provided for the filtering for the purpose of pressure regulation, wherein for the purpose of detecting continuous injection a second filter is provided which is preferably embodied as a $PT_1$ filter. In this context, the second filter is preferably embodied as a relatively fast filter, that is to say reacts more dynamically to the measured high-pressure values, said filter having, in particular, a smaller time constant than the first high-pressure filter which is used for pressure regulation of the high pressure. The output pressure values of the filter which is used to detect continuous injection are also referred to here and below as a dynamic high pressure or dynamic rail pressure. The term "dynamic" indicates here, in particular, that said values are filtered with a comparatively fast time constant, with the result that very short-term fluctuations are averaged out but comparative dynamic detection of the high pressure which is actually instantaneously present is provided.

A time interval which is at least one second to at maximum three seconds, particularly preferably two seconds, is preferably used as a checking time interval. This time has proven particularly favorable for being able to rule out the fact that the detected drop in pressure is caused by the triggering of a deactivation valve.

The fact that the checking time interval occurs before the dropping of the high pressure means, in particular, that the checking time interval occurs before a starting time for the detection of the drop in the high pressure, in particular before a starting time for the predetermined continuous injection time interval, wherein the starting time is preferably at the same time an end time of the checking time interval. Said time interval is therefore configured as a sliding time interval which extends from the starting time into the past.

Progressively checking whether a deactivation valve which connects the high-pressure accumulator to a fuel reservoir has been triggered means, in particular, that said deactivation valve is continually monitored, in particular continuously or at predetermined time intervals, within the scope of the method.

Preferably an overpressure valve, in particular a mechanical overpressure valve and/or a pressure regulating valve which can be actuated is used as a deactivation valve. It is possible for the injection system to have just one mechanical overpressure valve which is triggered above a predetermined overpressure actuation pressure value and relieves the pressure at the high-pressure accumulator in the direction of the fuel reservoir. This serves to maintain the safety of the injection system and avoids unacceptably high pressures in the high-pressure accumulator.

Alternatively or additionally, it is possible that a pressure regulating valve which can be actuated is provided as the deactivation valve. Said valve can serve in a normal operating mode of the internal combustion engine to make available an interference variable in the form of a specific flow of fuel from the high-pressure accumulator into the fuel reservoir, in order to stabilize pressure regulation which is, by the way, brought about for example via an intake throttle which is assigned to a high-pressure pump, wherein it is possible, in particular, that the intake throttle serves as a first pressure actuating element in a high-pressure closed-loop control circuit, wherein the pressure regulating valve which can be actuated is actuated as a second pressure actuating element. It is possible that in the event of a failure of the intake throttle, the pressure regulating valve which can be actuated completely assumes the regulation of the high pressure in a regulating mode, preferably by means of a second high-pressure closed-loop control circuit by which the pressure regulating valve which can be actuated is actuated as a sole pressure actuating element. A failure of the intake throttle is detected here, in particular, by virtue of the fact that the high pressure rises above a predetermined regulation-deactivation pressure value. In this case, the pressure regulating valve which can be actuated is then actuated to perform pressure regulation and typically opened further than when it generates an interference variable merely as a second pressure actuating element in the normal operating mode.

In particular, if a mechanical overpressure valve is not provided but instead a pressure regulating valve which can be actuated, it is possible that the latter additionally also assumes the protective function of the mechanical overpressure valve. In this case, the pressure regulating valve which can be actuated is preferably controlled if the high pressure exceeds a predetermined overpressure-deactivation pressure value, with the result that the pressure of the high-pressure accumulator can be relieved into the fuel reservoir.

It is clear that the high pressure drops at least briefly if the mechanical overpressure valve opens and/or if the pressure regulating valve which can be actuated is either actuated for the first time to regulate the pressure or else to relieve the pressure of the high-pressure accumulator in the sense of the protective function of an overpressure valve. So that such a drop in pressure is not incorrectly detected as continuous injection, within the scope of the method it is therefore checked—in particular progressively—whether a deactivation valve has been triggered, wherein continuous injection is detected only when no deactivation valve has been triggered in the predetermined checking time interval.

An embodiment of the method is preferred which is distinguished by the fact that the continuous injection checking as to whether the high pressure has dropped by the predetermined continuous injection differential pressure absolute value within the predetermined continuous injection time interval is carried out only if no deactivation valve has been triggered in the predetermined checking time interval before a starting time of checking of the continuous injection. Therefore, in this embodiment of the method not only is no direct injection detected in the event of a deactivation valve having been triggered in the checking interval, but instead the checking as to whether the high pressure has dropped, at any rate in the checking time interval—in particular measured from the triggering of a deactivation valve in this case—is not actually carried out if a deactivation valve has been triggered. This configuration of the method is particularly economical because in this way there can be a saving in computing time and computing resources. There is no need here for more wide ranging evaluation of any drop in pressure if it is already clear on the basis of the triggering of a deactivation valve that a subsequent drop in pressure can at any rate not be attributed reliably to continuous injection.

An embodiment of the method is preferred which is distinguished by the fact that the continuous injection checking is started at the starting time if the high pressure undershoots a high pressure setpoint value by a predetermined starting differential pressure absolute value. In this way, the starting point for the predetermined continuous injection time interval is defined in a reliable, appropriate and parametrizable fashion. The high pressure is evaluated as a function of the time, wherein the measurement of the predetermined continuous injection time interval, consequently the measurement of the drop in the high pressure and therefore the continuous injection checking at the starting time begins precisely when the high pressure drops below the high-pressure setpoint value by the predetermined starting differential pressure absolute value. Therefore, in particular unnecessary and therefore uneconomical triggering of the continuous injection checking by slight fluctuations in the high pressure about the high-pressure setpoint value can be avoided. The predetermined starting differential pressure absolute value can readily be selected in an appropriate fashion such that the checking only starts when there is actually a risk of a drop in pressure which goes beyond the usual fluctuations about the high-pressure setpoint value.

An embodiment of the method is preferred which is distinguished by the fact that a starting high pressure is determined at the starting time, wherein the predetermined continuous injection time interval is determined as a function of the starting high pressure. This configuration of the method is based on the concept that the drop in pressure which is brought about by continuous injection takes place all the more quickly the higher the instantaneous high pressure, consequently the starting high pressure, at the beginning of the continuous injection event. The dependence of the predetermined continuous injection time interval on the starting high pressure therefore serves to permit appropriate and reliable detection of continuous injection in a widest possible range of values for the high pressure. It is possible that the dependence of the continuous injection time interval on the starting high pressure is stored in the form of a characteristic curve, a function or a characteristic diagram. Storage in the form of a lookup table is also possible. The table represented below shows preferred values for the starting high pressure $p_{dyn,S}$ on the one hand, and preferred values assigned to these values for the predetermined continuous injection time interval $\Delta t_L$ on the other:

| $p_{dyn,S}$/bar | $\Delta t_L$/ms |
|---|---|
| 600 | 150 |
| 800 | 135 |
| 1000 | 120 |
| 1200 | 105 |
| 1400 | 90 |
| 1600 | 75 |
| 1800 | 60 |
| 2000 | 55 |
| 2200 | 40 |

An embodiment of the method is preferred which is distinguished by the fact that in order to check whether a deactivation valve has been triggered, it is checked whether the high pressure has reached or exceeded a predetermined deactivation pressure absolute value in the checking time interval. As already explained above, a deactivation valve is triggered, in particular, if a predetermined pressure limiting value or pressure absolute value is exceeded. Various deactivation pressure absolute values can be used within the scope of the method depending on the type and number of the deactivation valves which the injection system has. For example, preferably an overpressure deactivation pressure absolute value which is configured for triggering a mechanical overpressure valve when such a valve is provided is preferably used as the deactivation pressure absolute value. Alternatively or additionally, a second overpressure deactivation pressure absolute value, which is, if appropriate, different from the first overpressure deactivation pressure absolute value, is preferably used for actuating a pressure regulating valve which can be actuated, if said valve assumes the protective function of a mechanical overpressure valve for the injection system, in which case no mechanical overpressure valve is preferably provided. Alternatively or additionally, a regulating-deactivating pressure absolute value for the triggering of a pressure regulating valve which can be actuated is used as a deactivation pressure absolute value, said pressure absolute value being defined in such a way that at this pressure absolute value the pressure regulating valve is actuated as the sole pressure actuating element if, for example, an intake throttle fails and the regulation of pressure is to take place solely by means of the pressure regulating valve which can be actuated. It is clear that exceeding of at least one of these deactivation pressure absolute values causes the corresponding deactivation valve to be triggered. As a result, a drop in pressure occurs which is not to be incorrectly assigned to a continuous injection event. Therefore it is appropriate that it is checked whether at least one of the predetermined deactivation pressure absolute values has been reached or exceeded in the checking time interval.

An embodiment of the method is preferred which is distinguished by the fact that the continuous injection checking is carried out only if the internal combustion engine has left a predetermined starting phase. This ensures that the internal combustion engine has reached its normal operating mode, with the result that pressure fluctuations in the high pressure—and in particular also a drop thereof—cannot be attributed to the effects of the starting of the internal combustion engine. The fact that the internal combustion engine has left the predetermined starting phase means, in particular, that it has reached or exceeded a predetermined idling rotational speed for the first time.

Alternatively or additionally there is preferably provision that the continuous injection checking is carried out only if the high pressure has reached or exceeded a high-pressure setpoint value for the first time since the starting of the internal combustion engine. This also ensures that the operation of the internal combustion engine has stabilized insofar as the predetermined setpoint value for the high pressure, specifically the high-pressure setpoint value, has been reached or exceeded at least once since the starting of the internal combustion engine, with the result that it can be assumed that there is a normal operating mode of the internal combustion engine, wherein any pressure fluctuations and, in particular, a drop in pressure cannot be attributed to starting effects.

An embodiment of the method is preferred which is distinguished by the fact that after continuous injection checking—preferably independently of the result of the checking, that is to say independently of whether continuous injection has actually been detected or whether the checking has returned a negative result, that is to say the lack of continuous injection, a subsequent injection checking is only carried out if the high pressure has reached or exceeded the high-pressure setpoint value again. Therefore, if, for example, a drop in pressure is detected which, however, cannot be assigned to continuous injection but rather, for example, to the triggering of a pressure regulating valve which can be actuated or else the triggering of an overpressure valve, there is preferably a delay before the method is carried out to detect continuous injection again, until the high pressure has stabilized again, specifically until it has reached or exceeded the high-pressure setpoint value. Otherwise, no reliable interpretation of the detected results of the time-dependent high pressure profile can be ensured. Even if continuous injection has been detected, the method is preferably only carried out again if the high pressure has reached or exceeded the high-pressure setpoint value. However, this is preferably already ensured because, as is explained below, the internal combustion engine is preferably stopped when continuous injection is detected, wherein said engine is restarted at a later time, wherein there is then preferably a delay until a starting phase of the internal combustion engine and running up of the high pressure to or above the high-pressure setpoint value, before the method is carried out again.

An exemplary embodiment of the method is preferred which is distinguished by the fact that continuous injection is detected only if a fuel admission pressure is higher than or equal to a predetermined admission pressure setpoint value. The fuel admission pressure is preferably measured downstream of a low-pressure fuel feed pump, or referred to for short as low-pressure pump, and upstream of a fuel high-pressure pump, or referred to for short as high-pressure pump, that is to say between the low-pressure pump and the high-pressure pump, in particular upstream of the high-pressure pump. The comparison of the fuel admission pressure with the admission pressure setpoint value should prevent a drop in pressure incorrectly being assigned to continuous injection which actually originates from a drop in pressure of the fuel admission pressure. Such a drop in fuel admission pressure may be attributable, for example, to a defect in the low-pressure pump and also leads to a drop in the high pressure, when then should not be assigned, however, to continuous injection.

Continuous injection is preferably detected only if the fuel admission pressure is higher than or equal to the admission pressure setpoint value at the time of the drop in the high pressure, in particular at the end of the drop in pressure, that is to say at the moment when the high pressure resulting from the starting high pressure minus the continuous injection differential pressure absolute value is reached. Therefore, a relevant point in time at which it has to be ensured that the drop in pressure is not caused by a drop in the fuel admission pressure is advantageously defined.

If continuous injection is detected within the scope of the method, an alarm signal is preferably activated. The alarm signal preferably indicates to an operator of the internal combustion engine that continuous injection is occurring.

Alternatively or additionally, an engine stop signal is preferably activated if continuous injection is detected. The internal combustion engine is preferably shut down on the basis of the engine stop signal. In this way, the internal combustion engine is quickly and reliably protected against damage arising from the present continuous injection.

There is preferably provision that the engine stop signal is reset if the internal combustion engine is stationary. It is then advantageously possible to start the internal combustion engine again, in particular if the problem on which the continuous injection is based is eliminated.

There is preferably provision that the alarm signal is reset if an alarm signal reset key is activated by an operator of the internal combustion engine. In this way, the alarm can be reset, in particular if the problem on which the continuous injection is based has been eliminated. The internal combustion engine can then be started again.

The object is also achieved in that an injection system for an internal combustion engine is provided, which injection system has at least one injector and at least one high-pressure accumulator which is fluidically connected, on the one hand, to the at least one injector and, on the other hand, to a fuel reservoir via a high-pressure pump. The injection system also has a high-pressure sensor arranged and configured to detect a high pressure in the injection system. Furthermore, the injection system has at least one deactivation valve via which the high-pressure accumulator is fluidically connected to the fuel reservoir. The injection system also has a control unit which is operatively connected to the at least one injector, to the high-pressure sensor and preferably to the at least one deactivation valve. In this context, the injection system is distinguished in that the control unit is configured to monitor the high pressure in the injection system as a function of time and to check, in order to detect continuous injection, whether the high pressure has dropped by a predetermined continuous injection differential pressure absolute value within a predetermined continuous injection time interval. The control unit is also configured to check, in particular progressively, whether the at least one deactivation valve has been triggered. The control unit is finally configured to detect continuous injection if, and preferably only if, no deactivation valve has been triggered in a predetermined checking time interval before the dropping of the high pressure and if the high pressure has dropped by the predetermined continuous injection differential pressure absolute value within the predetermined continuous injection time interval. The control unit is preferably configured to implement one of the embodiments of the method described above. In particular the advantages which have already been explained in conjunction with the method are realized in conjunction with the injection system.

An exemplary embodiment of the injection system is preferred which is distinguished by the fact that the at least one deactivation valve is selected from a group comprising a mechanical overpressure valve and a pressure regulating valve. An exemplary embodiment of the injection system is also particularly preferred in which a mechanical overpressure valve and a pressure regulating valve which can be actuated are provided. However, an exemplary embodiment of the injection system in which just a mechanical overpressure valve and no pressure regulating valve which can be actuated is provided is also preferred. Furthermore, an exemplary embodiment of the injection system is preferred in which just one pressure regulating valve which can be actuated and no mechanical overpressure valve is provided.

The control unit is configured to check whether one of the deactivation valves which is present has been triggered. It is configured, in particular, to check whether a mechanical overpressure valve and/or a pressure regulating valve which can be actuated have/has been triggered.

The object is also finally achieved in that an internal combustion engine is provided which has an injection system according to one of the exemplary embodiments described above. Here, essentially the advantages which have already been described in conjunction with the method and the injection system are realized in conjunction with the internal combustion engine.

The internal combustion engine is preferably embodied as a reciprocating piston engine. It is possible that the internal combustion engine is configured to drive a passenger car, a truck or a utility vehicle. In one preferred exemplary embodiment, the internal combustion engine is used to drive, in particular, relatively heavy land vehicles or watercraft, for example mining vehicles, trains, wherein the internal combustion engine is used in a locomotive or a tractive unit, or ships. The use of the internal combustion engine for driving a vehicle used for defense purposes, for example a tank, is possible. An exemplary embodiment of the internal combustion engine is preferably also used in a fixed fashion, for example for a fixed energy supply in emergency power mode, continuous load mode or peak load mode, wherein the internal combustion engine preferably drives a generator in this case. A fixed application of the internal combustion engine for driving auxiliary assemblies, for example fire extinguishing pumps on rigs, is also possible. Furthermore, it is also possible to use the internal combustion engine in the field of the mining of fossil raw materials and, in particular, fossil fuels, in particular oil and/or gas. The use of the internal combustion engine in the industrial field or in the field of construction, in particular in a construction machine, for example in a crane or an excavator, is also possible. The internal combustion engine is preferably embodied as a diesel engine, as a petrol engine, as a gas engine for operation with natural gas, biogas, special gas or some other suitable gas. In particular, if the internal combustion engine is embodied as a gas engine, it is suitable for use in a cogeneration plant for the fixed generation of energy.

It is possible that the injection system has a separate control unit which is configured in a way described above. Alternatively or additionally, it is possible for the functionality described above to be integrated into a control unit of the internal combustion engine, or for the control unit to be embodied as a control unit of the internal combustion engine. The functionality described above is particularly preferably integrated into a central control unit of the internal combustion engine (engine control unit—ECU), or the control unit is embodied as a central control unit of the internal combustion engine.

It is possible that the functionality described above is implemented in an electronic structure, in particular a hardware of the control unit. Alternatively or additionally, it is possible that a computer program product is loaded into the control unit which has instructions on the basis of which the functionality described above and, in particular, the method steps described above are executed when the computer program product runs on the control unit.

In this respect, a computer program product is also preferred which has machine-readable instructions on the basis of which the functionality described above or the method steps described above are executed when the computer program product runs on a computing device, in particular a control unit.

Furthermore, a data carrier is preferred which has such a computer program product.

The description of the method, on the one hand, and of the injection system and the internal combustion engine, on the other, are to be understood as complementary to one another. Method steps which have been described explicitly or implicitly in conjunction with the injection system and/or the internal combustion engine are, preferably individually or when combined with one another, steps of a preferred embodiment of the method. Features of the injection system and/or of the internal combustion engine which have been explained explicitly or implicitly in conjunction with the method are preferably, individually or when combined with one another, features of a preferred exemplary embodiment of the injection system or of the internal combustion engine. The method is preferably distinguished by at least one method step which is conditioned by at least one feature of the injection system and/or the internal combustion engine. The injection system and/or the internal combustion engine are preferably distinguished by at least one feature which is conditioned by at least one method step of the inventive embodiment, or of a preferred embodiment, of the method.

BRIEF DESCRIPTION OF THE DRAWING

The invention will be explained in more detail below with reference to the drawing, in which.

DETAILED DESCRIPTION OF THE INVENTION

Figure 1:
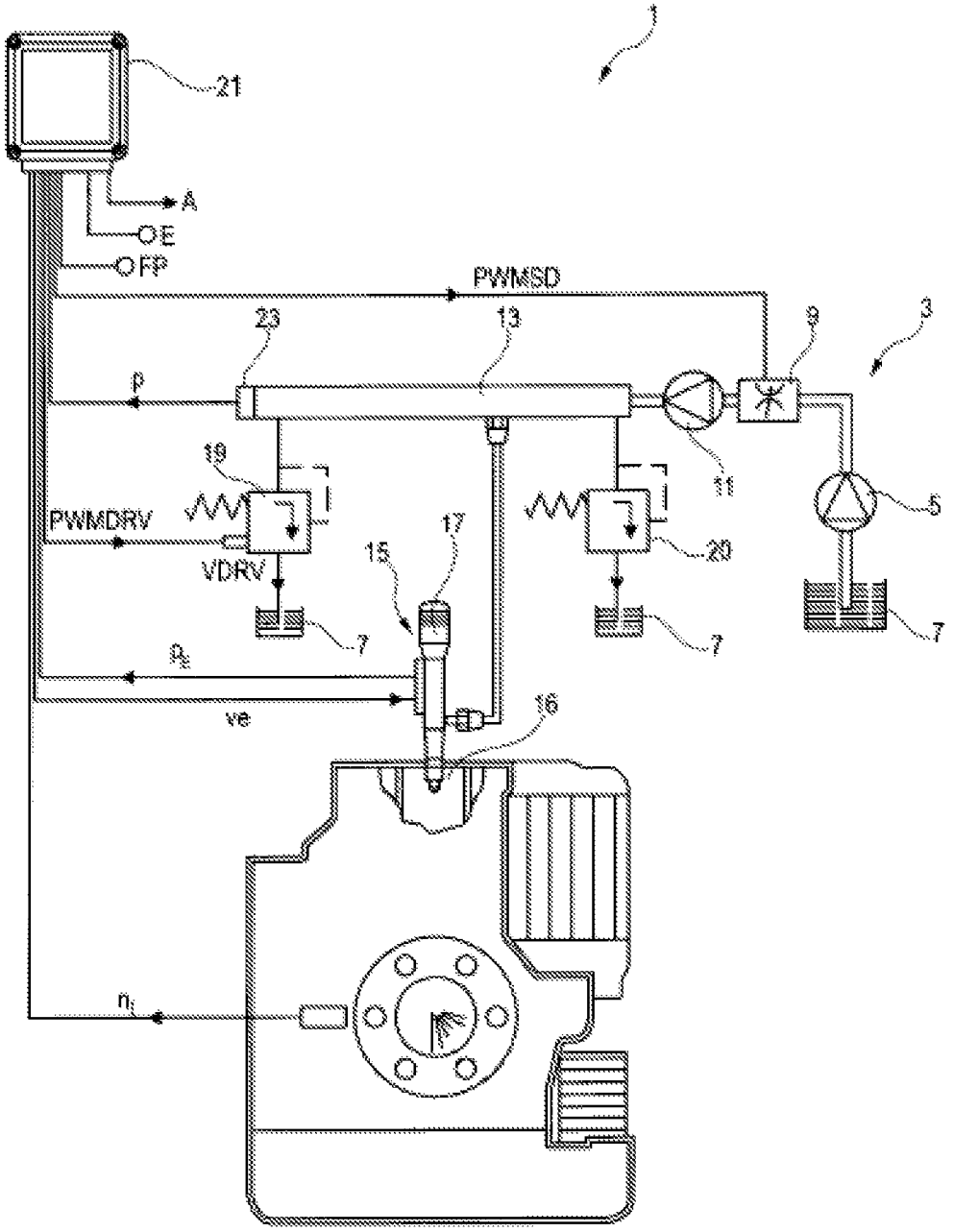
FIG. 1 shows a schematic illustration of an exemplary embodiment of an internal combustion engine.

FIG. 1 shows a schematic illustration of an exemplary embodiment of an internal combustion engine 1 which has an injection system 3. The injection system 3 is preferably embodied as a common rail injection system. It has a low-pressure pump 5 for feeding fuel from a fuel reservoir 7, an adjustable, low-pressure-side intake throttle 9 for influencing a fuel volume flow which flows to a high-pressure pump 11, the high-pressure pump 11 for feeding the fuel under an increase in pressure into a high-pressure accumulator 13, the high-pressure accumulator 13 for storing the fuel and preferably a multiplicity of injectors 15 for injecting the fuel into combustion spaces 16 of the internal combustion engine 1. It is optionally possible for the injection system 3 also to be embodied with individual accumulators, wherein then, for example in the injector 15, an individual accumulator 17 is integrated as an additional buffer volume. In the exemplary embodiment illustrated here, a pressure regulating valve 19 which can be actuated, in particular, electrically is provided, via which pressure regulating valve 19 the high-pressure accumulator 13 is fluidically connected to the fuel reservoir 7. By means of the position of the pressure regulating valve 19, a fuel volume flow, which is diverted from the high-pressure accumulator 13 into the fuel reservoir 7, is defined. This fuel volume flow is referred to by VDRV in FIG. 1 and in the following text.

The injection system 3 which is illustrated here has a mechanical overpressure valve 20 which also connects the high-pressure accumulator 13 to the fuel reservoir 7. The mechanical overpressure valve 20 is triggered, that is to say it opens, if the high pressure in the high-pressure accumulator 13 reaches or exceeds a predetermined overpressure deactivation pressure absolute value. The high-pressure accumulator 13 is then relieved of pressure via the mechanical overpressure valve 20 to the fuel reservoir 7. This serves to increase the safety of the injection system 3 and avoids unacceptably high pressure in the high-pressure accumulator 13.

The mode of operation of the internal combustion engine 1 is determined by an electronic control unit 21 which is preferably embodied as an engine control unit (ECU) of the internal combustion engine 1. The electronic control unit 21 includes the customary components of a microcomputer system, for example a microprocessor, I/O modules, buffers and memory modules (EEPROM, RAM). The operational data which is relevant for the operation of the internal combustion engine 1 is applied in the memory modules in characteristic diagrams/characteristic curves. By means of the latter, the electronic control unit 21 calculates output variables from input variables. The following input variables are illustrated in FIG. 1 by way of example: a measured, still unfiltered high pressure p which prevails in the high-pressure accumulator 13 and is measured by means of a high-pressure sensor 23, a current engine rotational speed $n_I$, a signal FP for the predefinition of the power by an operator of the internal combustion engine 1, and an input variable E. Preferably further sensor signals, for example a charge air pressure of an exhaust gas turbocharger, are combined under the input variable E. In the case of an injection system 3 with individual accumulators 17, an individual accumulator pressure $p_E$ is preferably an additional input variable of the control unit 21.

FIG. 1 illustrates as output variables of the electronic control unit 21, by way of example, a signal PWMSD for actuating the intake throttle 9 as a first pressure actuating element, a signal ve for actuating the injectors 15—which predefines, in particular, a start of injection and/or an end of injection or an injection duration—, a signal PWMDRV for actuating the pressure regulating valve 19 as a second pressure actuating element and an output variable A. The position of the pressure regulating valve 19 and therefore the fuel volume flow VDRV are defined by means of the preferably pulse-width-modulated signal PWMDRV. The output variable A is representative of further actuating signals for the open-loop and/or closed-loop control of the internal combustion engine 1, for example of an actuating signal for activating a second exhaust gas turbocharger in the case of register charging.

Figure 2:
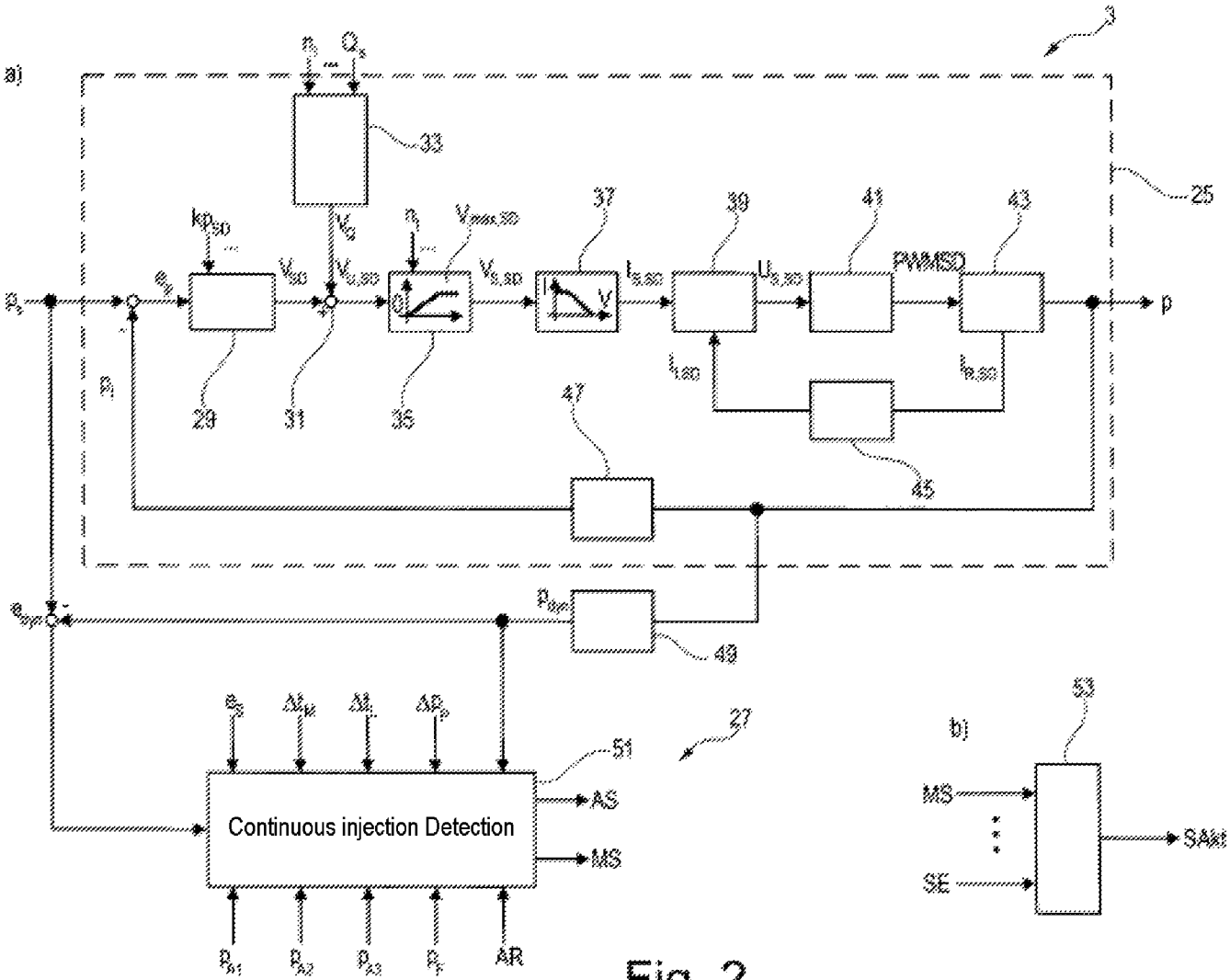
FIG. 2 shows a schematic illustration of a detail of an exemplary embodiment of an injection system.

FIG. 2*a*) shows a schematic illustration of a detail of an exemplary embodiment of an injection system 3. Here, a high-pressure regulating circuit 25, which is configured to regulate the high pressure in the high-pressure accumulator 13 is illustrated schematically in a box which is represented by a dashed line. Outside the high-pressure regulating circuit 25 or the box which is characterized by means of the dashed line a continuous injection detection function 27 is illustrated.

Firstly, the method of functioning of the high-pressure regulating circuit 25 will be explained in more detail: an input variable of the high-pressure regulating circuit 25 is a setpoint high pressure $p_S$ which is determined by the control unit 21 and is compared with an actual high pressure $p_I$ in order to calculate a regulating error $e_p$. The setpoint high pressure $p_S$ is preferably read out from a characteristic diagram as a function of a rotational speed $n_I$ of the internal combustion engine 1, of a load request or torque request to the internal combustion engine 1 and/or as a function of further variables which serve, in particular, for correction. Further input variables of the high-pressure regulating circuit 25 are, in particular, the rotational speed $n_I$ of the internal combustion engine 1 and a setpoint injection quantity $Q_S$. The high-pressure regulating circuit 25 has, as an output variable, in particular the high pressure p which is measured by the high-pressure sensor 23. Said high pressure p is subjected to a first filtering process, which will be explained in more detail below, wherein the actual high pressure $p_I$ arises from this first filtering process as an output variable. The regulating error $e_p$ is an input variable of a high-pressure regulator 29 which is preferably embodied as a PI(DT1) algorithm. A further input variable of the high-pressure regulator 29 is preferably a proportional coefficient $kp_{SD}$. The output variable of the high-pressure regulator 29 is a fuel setpoint volume flow $V_{SD}$ for the intake throttle 9, to which a fuel setpoint consumption $V_Q$ is added in an addition point 31. This fuel setpoint consumption $V_Q$ is calculated in a first calculation element 33 as a function of the rotational speed $n_I$ and the setpoint injection quantity $Q_S$ and constitutes an interference variable of the high-pressure regulating circuit 25. An unlimited fuel setpoint volume flow $V_{U,SD}$ is obtained as a sum of the output variable $V_{SD}$ of the high-pressure regulator 29 and the interference variable $V_Q$. Said fuel setpoint volume flow $V_{U,SD}$ is limited to a maximum volume flow $V_{max,SD}$ for the intake throttle 9 as a function of rotational speed $n_I$ in a limiter element 35. A limited fuel setpoint volume flow $V_{S,SD}$ for the intake throttle 9 which is obtained as an input variable in a pump characteristic curve 37 is obtained as an output variable of the limiter element 35. The limited fuel setpoint volume flow $V_{S,SD}$ is converted into an intake throttle setpoint flow $I_{S,SD}$ with said pump characteristic curve 37.

The intake throttle setpoint flow $I_{S,SD}$ constitutes an input variable of an intake throttle current regulator 39 which has the function of regulating an intake throttle current through the intake throttle 9. A further input variable of the intake throttle current regulator 39 is an actual intake throttle current $I_{I,SD}$. The output variable of the intake throttle current regulator 39 is an intake throttle setpoint voltage $U_{S,SD}$, which is finally converted into a switch-on duration of a pulse-width-modulated signal PWMSD for the intake throttle 9 in a second calculator element 41 in a manner known per se. The intake throttle 9 is actuated with said signal PWMSD, wherein the signal therefore acts overall on a regulated system 43 which has, in particular, the intake throttle 9, the high-pressure pump 11 and the high-pressure accumulator 13. The intake throttle current is measured, wherein a raw measured value $I_{R,SD}$ results which is filtered in a current filter 45. The current filter 45 is preferably embodied as a PT1 filter. The output variable of this current filter 45 is the actual intake throttle current $I_{L,SD}$ which is in turn fed to the intake throttle current regulator 39.

The regulated variable of the first high-pressure regulating circuit 25 is the high pressure p in the high-pressure accumulator 13. Raw values of this high pressure p are measured by the high-pressure sensor 23 and filtered by a first high-pressure filter element 47 which has the actual high pressure $p_I$ as the output variable. The first high-pressure filter element 47 is preferably converted by a PT1 algorithm.

In the text which follows, the method of functioning of the continuous injection detection function 27 will be explained in more detail: the raw values of the high pressure p are filtered by a second high-pressure filter element 49, the output variable of which is a dynamic rail pressure $p_{dyn}$. The second high-pressure filter element 49 is preferably converted by a PT1 algorithm. A time constant of the first high-pressure filter element 47 is preferably greater than a time constant of the second high-pressure filter element 49. In particular, the second high-pressure filter element 49 is embodied as a faster filter than the first high-pressure filter element 47. The time constant of the second high-pressure filter element 49 can also be identical to the value zero, with the result that the dynamic rail pressure $p_{dyn}$ corresponds to the measured raw values of the high pressure p, or is identical thereto. The dynamic rail pressure $p_{dyn}$ therefore constitutes a highly dynamic value for the high pressure which is, in particular, always appropriate if a fast reaction has to take place to certain events which occur.

A difference between the setpoint high pressure $p_S$ and the dynamic rail pressure $p_{dyn}$ results in a dynamic high-pressure regulating error $e_{dyn}$. The dynamic high-pressure regulating error $e_{dyn}$ is an input variable of a functional block 51 for detecting continuous injection. Further, in particular parametrizable, input variables of the functional block 51 are various deactivation pressure absolute values, specifically here a first overpressure deactivation pressure absolute value $p_{A1}$, at or above which the mechanical overpressure valve 20 is triggered, a regulating deactivation pressure absolute value $p_{A2}$, at or above which the pressure regulating valve 19 which can be actuated is actuated in order to perform high pressure regulation as the sole pressure actuating element, for example if the intake throttle 9 fails, and a second overpressure deactivation pressure absolute value $p_{A3}$ at or above which the pressure regulating valve 19 which can be actuated is, preferably completely, actuated, in order to assume a protective function for the injection system 3 and therefore, as it were, to replace or supplement the mechanical overpressure valve 20. Further, in particular parametrizable, input variables are a predetermined starting differential pressure absolute value $e_S$, a predetermined checking time interval $\Delta t_M$, a predetermined continuous injection time interval $\Delta t_L$, a predetermined continuous injection differential pressure absolute value $\Delta p_P$, a fuel admission pressure $p_F$, the dynamic rail pressure $p_{dyn}$ and an alarm resetting signal AR. The output variables of the functional block 51 are an engine stop signal MS and an alarm signal AS.

FIG. 2*b*) shows that when the engine stop signal MS assumes the value 1, i.e. is set to said value, it triggers an engine stop, in which case a logic signal SAkt which brings about a stop of the internal combustion engine 1 is also set. The triggering of an engine stop can also have different causes, for example the setting of an external engine stop. In this context, an external stop signal SE is identical to the value 1 and the resulting logic signal SAkt also becomes identical to the value 1, since all the possible stop signals are connected to one another by a logic OR operation 53.

Figure 3:
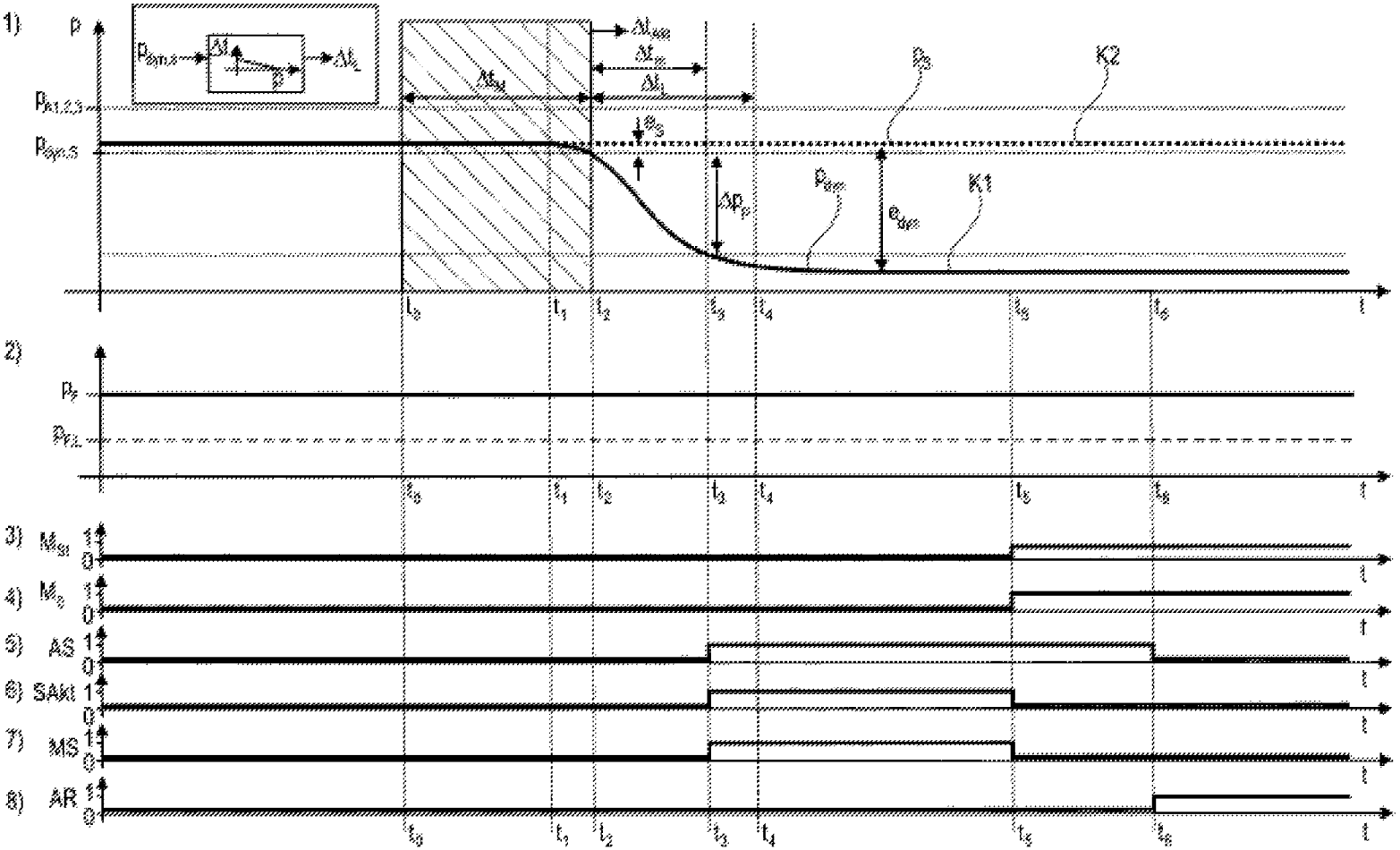
FIG. 3 shows a schematic illustration of an embodiment of the method in a diagrammatic illustration.

FIG. 3 shows a schematic illustration of an embodiment of the method in a diagrammatic illustration, in particular in the form of various time diagrams which are illustrated together. In this context, the time diagrams are denoted, from top to bottom, as the first, second etc. The first diagram is therefore, in particular, the top diagram in FIG. 3, which is adjoined in the downward direction by the following, correspondingly numbered diagrams.

The first diagram represents the time profile, as a function of a time parameter t, of the dynamic rail pressure $p_{dyn}$ as a continuous curve K1 and the time profile of the setpoint high pressure $p_S$ as a dashed curve K2. Up until a first point in time $t_1$, both curves K1, K2 are identical. From the first point in time $t_1$ onward, the dynamic rail pressure $p_{dyn}$ becomes lower, while the setpoint high pressure $p_S$ remains constant. As a result, a positive dynamic high-pressure regulating error $e_{dyn}$ is obtained which is identical to a second point in time $t_2$ with the predetermined starting differential pressure absolute value es. At this point in time a counter $\Delta t_{Akt}$ starts. The dynamic rail pressure $p_{dyn}$ is identical to a starting high pressure $p_{dyn,S}$ at a second point in time t2. At a third point in time $t_3$ the dynamic rail pressure $p_{dyn}$ has dropped by the predetermined continuous injection differential pressure absolute value $\Delta p_P$, starting from the starting high pressure $p_{dyn,S}$. A typical value for $\Delta p_P$ is preferably 400 bar. The counter $\Delta t_{Akt}$ assumes the following value at the third point in time $t_3$:

$$\Delta t_{Akt}=\Delta t_m=t_3-t_2$$

Continuous injection is detected if the measured time period $\Delta t_m$, that is to say that time period during which the dynamic rail pressure $p_{dyn}$ drops by the predetermined continuous injection differential pressure absolute value $\Delta p_P$, is smaller than or equal to the predetermined continuous injection time interval $\Delta t_L$:

$$\Delta t_m \leq \Delta t_L$$

The predetermined continuous injection time interval $\Delta t_L$ is preferably calculated from the starting high pressure $p_{dyn,S}$ by means of a two-dimensional curve, in particular a characteristic curve. The following applies here: the lower the starting high pressure $p_{dyn,S}$, the larger the predetermined continuous injection time interval $\Delta t_L$. Typical values for the predetermined continuous time interval $\Delta t_L$ are given in the following table as a function of the starting high pressure $p_{dyn,S}$:

| $p_{dyn,\,S}$ [bar] | $\Delta t_L$ [ms] |
|---|---|
| 600 | 150 |
| 800 | 135 |
| 1000 | 120 |
| 1200 | 105 |
| 1400 | 90 |
| 1600 | 75 |
| 1800 | 60 |
| 2000 | 55 |
| 2200 | 40 |

In order to rule out the possibility of the dropping of the high pressure being caused by the triggering of a deactivation valve, within the scope of the method it is checked whether the high pressure has reached or exceeded at least one of the predetermined deactivation pressure absolute values, in particular the first overpressure deactivation pressure absolute value $p_{A1}$, the regulating deactivation pressure absolute value $p_{A2}$ and/or the second overpressure deactivating pressure absolute value $p_{A3}$ during the predetermined checking time interval $\Delta t_M$.

If this is the case, that is to say if a deactivation valve has been triggered in the predetermined checking time interval $\Delta t_M$, continuous injection is not detected. In this case, no continuous injection checking is particularly preferably carried out, that is to say in particular at any rate in the checking time interval starting from a triggering of a deactivation valve it is not checked whether the high pressure has dropped by the predetermined continuous injection differential pressure absolute value $\Delta p_P$ within the predetermined continuous injection time interval $\Delta t_L$. A preferred value for the checking time interval $\Delta t_M$ is a value of 2 s.

If no deactivation valve has been triggered in the predetermined checking time interval and if the high pressure has not dropped by at least the predetermined continuous injection differential pressure absolute value $\Delta p_P$ at the third point in time $t_3$ within the predetermined continuous injection time interval $\Delta t_L$, it is checked whether the fuel admission pressure $p_F$ is higher than or equal to a predetermined admission pressure setpoint value $p_{F,L}$. If this is the case, as illustrated in the second diagram, continuous injection is detected. If this is not the case, it is assumed that the fuel admission pressure could be responsible for the dropping of the high pressure, and continuous injection is not detected.

A precondition for the execution of the continuous injection checking is also that the internal combustion engine 1 has left a starting phase. This is the case when the internal combustion engine 1 has reached a predetermined idling rotational speed for the first time. A binary engine starting signal $M_{St}$ which is illustrated in the third diagram then assumes the logic value 0. If a stationary state of the internal combustion engine 1 is detected, this signal is set to the logic value 1.

A further precondition for the execution of the continuous injection checking is that the dynamic rail pressure $p_{dyn}$ has reached the setpoint high pressure $p_S$ for the first time.

If continuous injection is detected at the third point in time $t_3$, the alarm signal AS is set, which alarm signal AS changes from the logic value 0 to the logic value 1 in the fifth diagram. At the same time, when continuous injection is detected the internal combustion engine 1 must be shut down. Correspondingly, the engine stop signal MS, which indicates that an engine stop is triggered as a result of the detection of continuous injection, must be changed from the logic value 0 to the logic value 1, which is illustrated in the seventh diagram. The same applies to the signal SAkt which brings about a stop of the internal combustion engine 1 and which finally leads to the shutting down of the internal combustion engine 1, which is illustrated, in particular, in the sixth diagram.

At a fifth point in time $t_5$, a stationary state of the internal combustion engine 1 is detected, with the result that a stationary signal $M_0$ which is illustrated in the fourth diagram and which indicates that the internal combustion engine 1 is stationary changes from the logic value 0 to the logic value 1. At the same time, the value of the engine starting signal $M_{St}$ which is illustrated in the third diagram and which indicates the starting phase of the internal combustion engine 1 changes from the logic value 0 to the logic value 1, since the internal combustion engine 1 is in the starting phase again after the detected stationary state. If the internal combustion engine 1 is detected as being stationary, the two signals SAkt and MS are set again to 0, which is in turn illustrated in the sixth and seventh diagrams.

At a sixth point in time $t_6$, an alarm reset key is activated by the operator of the internal combustion engine 1, with the result that the alarm reset signal AR changes, as illustrated in the eighth diagram, from the logic value 0 to the logic value 1. This in turn results in the alarm signal AS, illustrated in the fifth diagram, being reset to the logic value 0.

If continuous injection is detected or if no continuous injection is detected before the expiry of the predetermined continuous injection time interval $\Delta t_L$, renewed continuous injection checking can be carried out after this only if the dynamic rail pressure $p_{dyn}$ has reached or exceeded the high pressure $p_S$ again:

$$p_{dyn} \geq p_S.$$

Figure 4:
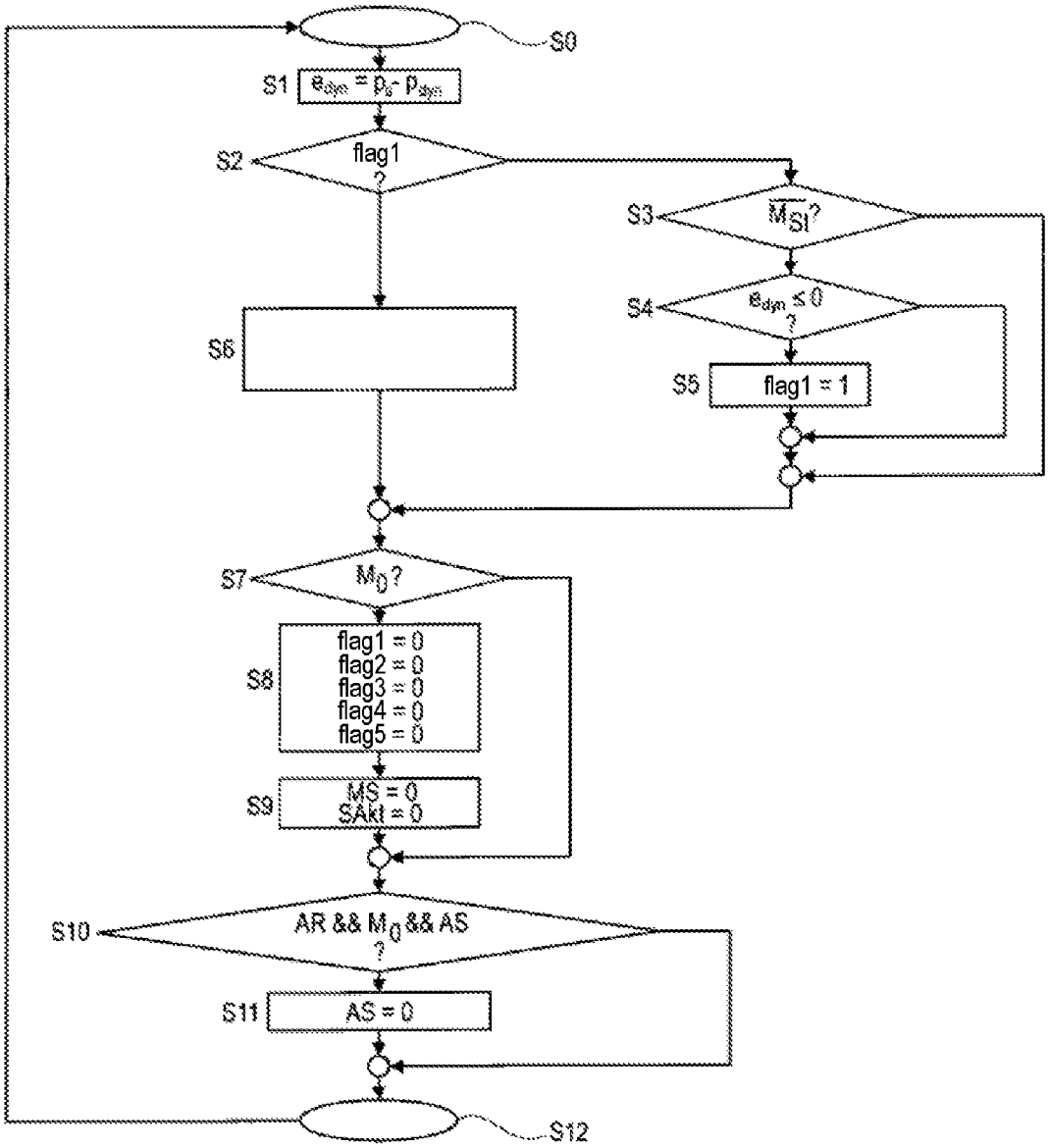
FIG. 4 shows a schematic illustration of an embodiment of the method as a flowchart.

FIG. 4 shows a schematic illustration of an embodiment of the method as a flowchart. In a starting step S0 the method starts. In a first step S1 the dynamic high-pressure regulating error $e_{dyn}$ is calculated as a difference between the setpoint high pressure $p_S$ and the dynamic rail pressure $p_{dyn}$. In a second step S2 it is interrogated whether a logic variable, denoted as flag1, is set.

In this context, the term "flag" denotes here and below a logic or binary variable which can assume two states, in particular 0 and 1. The fact that a flag is set means here and below that the corresponding logic variable has a first of the two states, in particular an active state, for example the value 1. The fact that the flag is not set means here and below that the logic variable has the other second state, in particular an inactive state, for example the value 0.

In the present embodiment of the method it is monitored by means of the logic variable flag1 whether the internal combustion engine 1 is in its starting phase and whether the high pressure has reached or exceeded the setpoint high pressure $p_S$ for the first time. The flag1 is set here if the internal combustion engine 1 is no longer in the starting phase and if the dynamic rail pressure $p_{dyn}$ has reached or exceeded the setpoint high pressure $p_S$ for the first time. If one of these conditions is not satisfied, the flag1 is not set.

Figure 5:
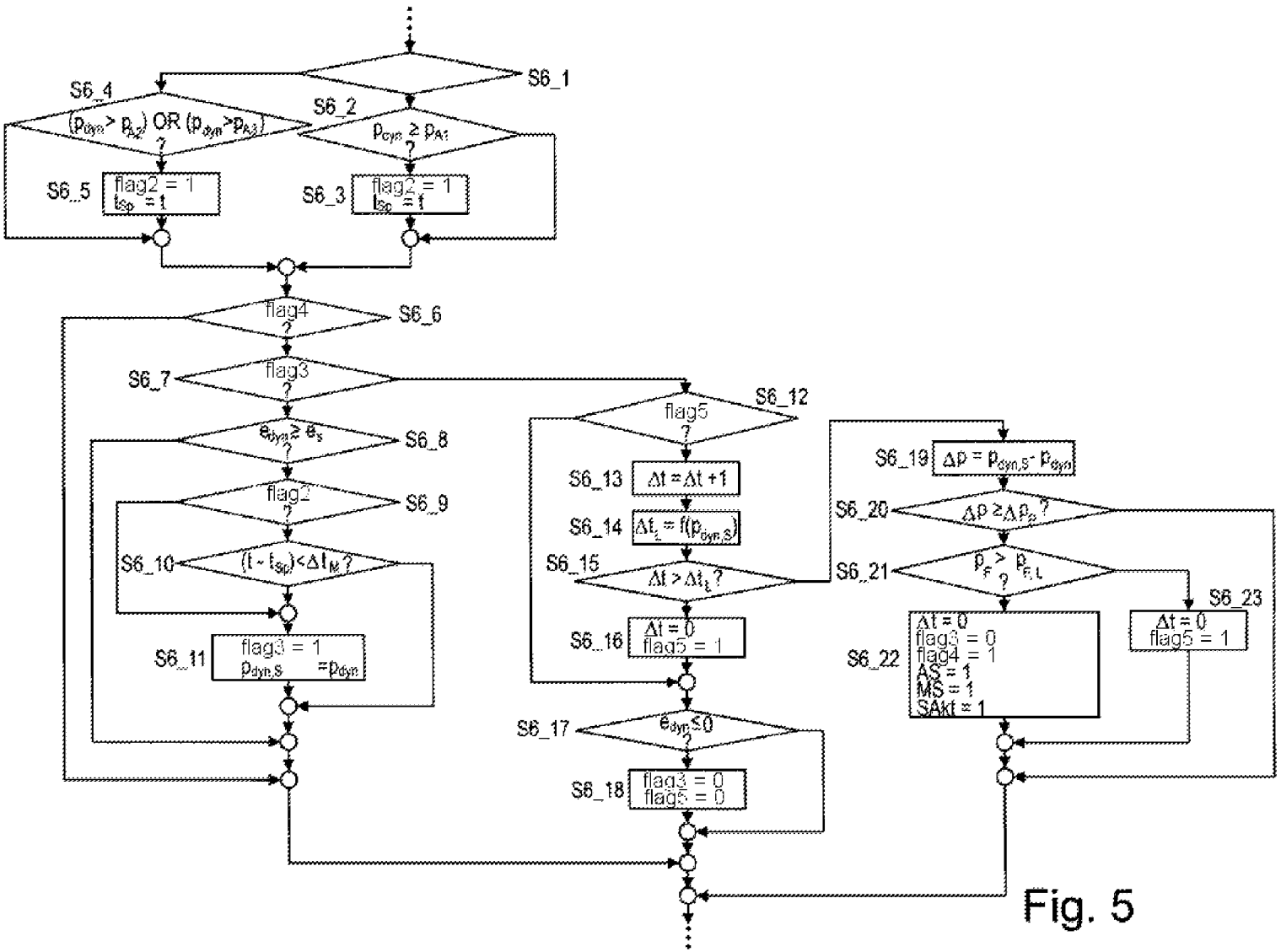
FIG. 5 shows a schematic illustration of a detail of the embodiment of the method according to FIG. 4.

If the flag1 is set, the method is continued with a continuous injection detection algorithm, illustrated in more detail in FIG. 5, in a sixth step S6.

If the flag is not set, the method is continued with a third step S3. In the third step S3 it is interrogated whether the internal combustion engine 1 has left the starting phase. If this is not the case, the method is continued in a seventh step S7. On the other hand, if this is the case, in a fourth step S4 it is checked whether the dynamic rail pressure regulating error $e_{dyn}$ is less than or equal to 0. If this is not the case, which means that the dynamic rail pressure $p_{dyn}$ has not yet reached or exceeded the setpoint high pressure $p_S$, the method is continued in the seventh step S7. If, on the other hand, the dynamic rail pressure error $e_{dyn}$ is less than or equal to 0, the flag1 is set in a fifth step S5.

In the seventh step S7 it is interrogated whether the internal combustion engine 1 is stationary. If this is not the case, the method is continued with a tenth step S10. If the internal combustion engine 1 is stationary, the flag1 is set and further logic variables flag2, flag3, flag4 and flag5 are reset.

As will be explained in more detail below, the flag2 indicates here whether a deactivation valve has been triggered, flag3 indicates whether the deactivation valve has been triggered in the checking time interval, the flag4 indicates that continuous injection has been detected and blocks in this respect subsequent executions of the continuous injection detection, in particular up to the stationary state and restarting of the internal combustion engine 1, and the flag5 finally indicates that the continuous injection checking has been carried out but no continuous injection has been detected, in which case said flag5 blocks in this respect, in particular, renewed execution of the continuous injection checking until the dynamic high pressure $p_{dyn}$ has reached or exceeded the setpoint high pressure $p_S$ again and/or until the internal combustion engine 1 has left its starting phase again, in the case of intermediate shutting down and restarting of said internal combustion engine 1.

In a ninth step S9, the logic engine stop signal MS which triggers stopping of the internal combustion engine 1 owing to detected continuous injection, and the logic signal SAkt which brings about stopping of the internal combustion engine are also reset. In a tenth step S10 it is checked whether both the alarm reset signal AR and the logic stationary signal $M_0$ which indicates a stationary state of the internal combustion engine as well as the alarm signal AS which indicates detected continuous injection are set. If at least one of these logic signals is not set, the method is ended in a twelfth step S12. If, on the other hand, all of these logic signals are set, the alarm signal AS is reset in an eleventh step S11.

The method is preferably carried out iteratively. This means, in particular, that after the method has ended in the twelfth step S12 it is started again, preferably immediately, in the starting step S0. Of course, there is preferably provision that this iterative execution of the method ends with complete switching off of the control unit 21, which is preferably configured to execute the method. The method then preferably starts again at the starting step S0 after a restart of the control unit 21.

FIG. 5 shows a schematic illustration of a detail of the embodiment of the method according to FIG. 4. In particular, FIG. 5 shows an illustration of a detail of the sixth step S6 according to the flowchart in FIG. 4, again in the form of a flowchart. In this context, the method steps executed within the step S6 are denoted below as substeps.

In a first substep S6_1 it is interrogated whether a mechanical overpressure valve 20 is present. This interrogation is not absolutely necessary. Instead, it is also possible for the method sequence to be adapted to the specific configuration of the internal combustion engine 1, wherein it is permanently implemented in the method sequence whether a mechanical overpressure valve 20 is present or not. In this case, the branching which is illustrated in the first substep S6_1 does not need to be provided, but instead can be directly followed by the method step which is suitable for the configuration of the internal combustion engine 1. The embodiment of the method which is described here has, however, the advantage that it can be set independently of the specific configuration of the internal combustion engine 1, with the result that it can be used very flexibly and can also be implemented very quickly in an existing control unit 21 of an internal combustion engine 1 as a retrofitting solution. By means of the interrogation in the first substep S6_1 the method then receives the information about the presence of a mechanical overpressure valve 20 which is necessary for the further progress.

If a mechanical overpressure valve 20 is present in the internal combustion engine 1, in a second substep S6_2 it is interrogated whether the dynamic rail pressure $p_{dyn}$ is higher than or equal to the first overpressure deactivation pressure absolute value $p_{A1}$. If this is not the case, the method continues with a sixth substep S6_6. If, on the other hand, this is the case, the flag2 is set in a third substep S6_3. A time variable $t_{Sp}$ is set at the same time to a current system time t. Subsequently, the method continues with the sixth substep S6_6. If a mechanical overpressure valve 20 is not present, branching occurs from the first substep S6_1 to a fourth substep S6_4. In the fourth substep S6_4 it is interrogated whether the dynamic rail pressure $p_{dyn}$ is higher than or equal to the regulating deactivation pressure absolute value $p_{A2}$ or greater than or equal to the second overpressure deactivation pressure absolute value $p_{A3}$. If this is not the case, the method is continued with the sixth substep S6_6. If this is the case, the flag2 is set in a fifth substep S6_5. At the same time, the time variable $t_{Sp}$ is set to the current system time t. Subsequently, the method is continued with the sixth substep S6_6.

In said substep S6_6 the flag4 is interrogated. If the latter is set, the method is continued with the seventh step S7 according to FIG. 4.

If the flag4 is not set, the flag3 is interrogated in a seventh substep S6_7. If the flag3 is set, the method is continued with a twelfth substep S6_12, and otherwise in an eighth substep S6_8 it is checked whether the dynamic rail pressure regulating error $e_{dyn}$ is greater than or equal to the starting differential pressure absolute value $e_S$. If this is not the case, the method is continued with the seventh step S7 according to FIG. 4. On the other hand, if this is the case, in a ninth substep S6_9 it is checked whether the flag2 is set. If the flag2 is not set, the method is continued with an eleventh substep S6_11. If the flag2 is set, in a tenth substep S6_10 it is checked whether the difference between the current system time t and the value of the time variable $t_{Sp}$ is less than or equal to the checking time interval $\Delta t_M$. If this is the case, the method is continued with the seventh step S7 according to FIG. 4. If this is not the case, in the eleventh substep S6_11 the flag3 is set, and the value of the currently prevailing dynamic rail pressure $p_{dyn}$ is assigned to the starting high pressure $p_{dyn,S}$.

In the twelfth substep S6_12 the flag5 is interrogated. If the flag5 is set, the method is continued with a seventeenth substep S6_17. If the flag5 is not set, a time difference variable $\Delta t$ is incremented in a thirteenth substep S6_13. Subsequently, in a fourteenth substep S6_14 the predetermined continuous injection time interval $\Delta t_L$ is calculated as an output value of a two-dimensional curve. The input value of this curve is the starting high pressure $p_{dyn,S}$.

In a fifteenth substep S6_15 it is interrogated whether the time difference variable $\Delta t$ is greater than the continuous injection time interval $\Delta t_L$. If this is not the case, the method is continued with a nineteenth substep S6_19. If this is the case, in the sixteenth substep S6_16 the time difference variable $\Delta t$ is set to the value 0 and the flag5 is set. Subsequently, in the seventeenth substep S6_17 is it interrogated whether the dynamic rail pressure regulating error $e_{dyn}$ is less than or equal to zero. If this is not the case, the method is continued with the seventh step S7 according to FIG. 4. On the other hand, if this is the case, flag3 and flag5 are respectively reset in an eighteenth substep S6_18. Subsequently, the method is continued with the seventeenth step S7 according to FIG. 4.

In the nineteenth substep S6_19, a differential pressure absolute value $\Delta p$ is calculated as a difference between the starting high pressure $p_{dyn,S}$ and the dynamic rail pressure $p_{dyn}$.

Subsequently, in a twentieth substep S6_20 it is checked whether the pressure difference absolute value $\Delta p$ is greater than or equal to the predetermined continuous injection differential pressure absolute value $\Delta p_P$. If this is not the case, the method is continued with the seventh step S7 according to FIG. 4. On the other hand, if this is the case, in a twenty-first substep S6_21 it is checked whether the fuel admission pressure $p_F$ is lower than the limiting value $p_{F,L}$. If this is the case, in a twenty-third step S6_23 the time difference variable Δt is set to the value 0 and the flag5 is set. Subsequently, the method is continued with the seventh step S7 according to FIG. 4. If the fuel admission pressure $p_F$ is not lower than the predetermined admission pressure setpoint value $p_{F,L}$, in a twenty-second substep S6_22 the time difference variable Δt is set to the value 0 and the flag3 is reset. The flag4 and the alarm signal AS, the engine stop signal MS and the logic signal SAkt which brings about an engine stop are set simultaneously. Subsequently, the method is also continued with the seventh step S7 according to FIG. 4.

Overall it becomes apparent that by using the method, injection system 3 and internal combustion engine 1 proposed here it is possible to detect continuous injection easily, cost effectively and very reliably, wherein it is particularly preferably possible to dispense with a quantity-limiting valve with the result that, in particular, it becomes possible to use cost-effective injectors for the injection system 3 and the internal combustion engine 1.

The invention claimed is:

1. A method for detecting continuous injection during operation of an internal combustion engine with an injection system having a high-pressure accumulator for a fuel, the method comprising the steps of:

monitoring a high pressure in the injection system as a function of time;

detecting continuous injection by checking whether the high pressure has dropped by a predetermined continuous injection differential pressure absolute value within a predetermined continuous injection time interval; and checking whether a deactivation valve which connects the high-pressure accumulator to a fuel reservoir has been triggered, wherein continuous injection is detected when no deactivation valve has been triggered in a predetermined checking time interval before the dropping of the high pressure, and when the high pressure has dropped by the predetermined continuous injection differential pressure absolute value within the predetermined continuous injection time interval, including carrying out the continuous injection checking out only when the internal combustion engine has left a predetermined starting phase and/or when the high pressure has reached or exceeded a high-pressure setpoint value for a first time since starting of the internal combustion engine.

2. The method according to claim 1, including carrying out a subsequent continuous injection checking after the continuous injection checking, only when the high pressure has reached or exceeded the high-pressure setpoint value again.

3. A method for detecting continuous injection during operation of an internal combustion engine with an injection system having a high-pressure accumulator for a fuel, the method comprising the steps of:

monitoring a high pressure in the injection system as a function of time;

detecting continuous injection by checking whether the high pressure has dropped by a predetermined continuous injection differential pressure absolute value within a predetermined continuous injection time interval; and checking whether a deactivation valve which connects the high-pressure accumulator to a fuel reservoir has been triggered, wherein continuous injection is detected when no deactivation valve has been triggered in a predetermined checking time interval before the dropping of the high pressure, and when the high pressure has dropped by the predetermined continuous injection differential pressure absolute value within the predetermined continuous injection time interval, wherein continuous injection is detected only when a fuel admission pressure is higher than or equal to a predetermined admission pressure setpoint value.

* * * * *